United States Patent [19]

Lewis

[11] 4,269,639

[45] May 26, 1981

[54] MANUFACTURE OF MINERAL INSULATED CABLES

[76] Inventor: Robert J. Lewis, Manchester, England

[21] Appl. No.: 117,010

[22] Filed: Jan. 30, 1980

[30] Foreign Application Priority Data

Feb. 8, 1979 [GB] United Kingdom ..... 7904410

[51] Int. Cl.[3] ..... H01B 13/06; H01B 13/22

[52] U.S. Cl. ..... 156/54; 29/868; 156/55; 174/102 P; 228/17.5; 228/130; 228/156; 228/173 D

[58] Field of Search ..... 156/54, 55, 48; 174/102 P; 228/126, 129, 130, 156, 173 C, 17.5, 173 D; 29/868

[56] References Cited

U.S. PATENT DOCUMENTS

| | | | |
|---|---|---|---|
| 275,408 | 4/1883 | Phillips et al. | 228/130 |
| 2,029,044 | 1/1936 | Westlinning | 228/130 |
| 2,164,267 | 6/1939 | Black | 228/130 |
| 3,737,997 | 6/1973 | Davis | 174/102 P |

FOREIGN PATENT DOCUMENTS

| | | | |
|---|---|---|---|
| 672272 | 5/1952 | United Kingdom | 228/156 |
| 706371 | 3/1954 | United Kingdom | 156/48 |

*Primary Examiner*—Jerome W. Massie

*Attorney, Agent, or Firm*—Kirschstein, Kirschstein, Ottinger & Cobrin

[57] ABSTRACT

In the manufacture of mineral insulated cable, by a continuous process in which the tubular sheath is formed by bending and seam welding travelling metal strip, and insulating powder and conductor wires are continuously delivered into the sheath, one wire is fed through a guide tube extending into the sheath beyond the weld point, and having an aperture in its wall adjacent to the weld area. The wire so exposed directly to the heat from the weld conducts excess heat away from the weld, thus preventing thermal damage, in particular to a powder delivery tube if present. The guide tube is so arranged that powder is excluded from the weld area. When the sheath is formed of an oxidizable metal such as copper, a continuous stream of rare gas is delivered to the underside of the weld area. Forms of apparatus for carrying out vertical and horizontal processes are described.

10 Claims, 6 Drawing Figures

Figure 1:
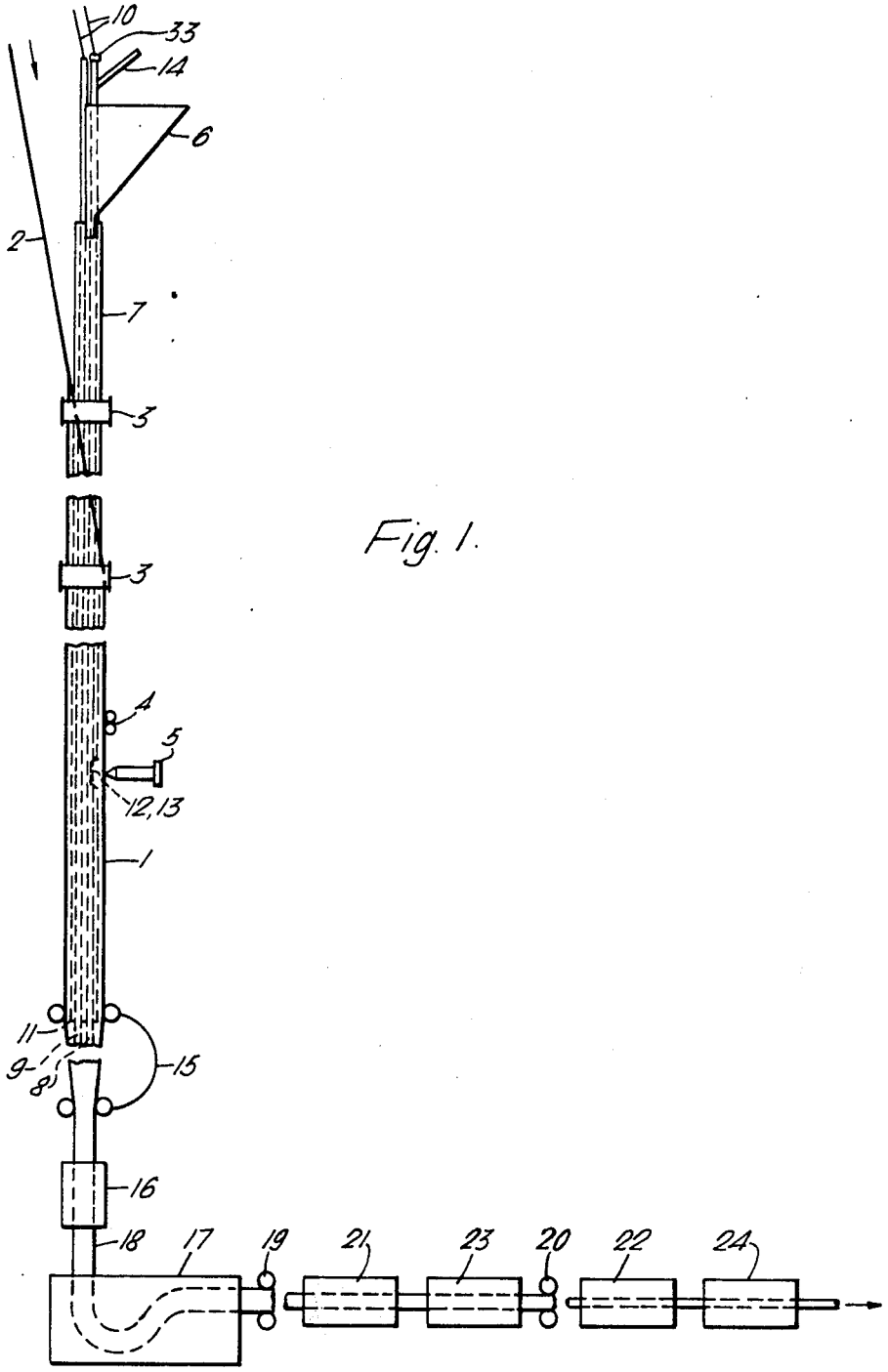

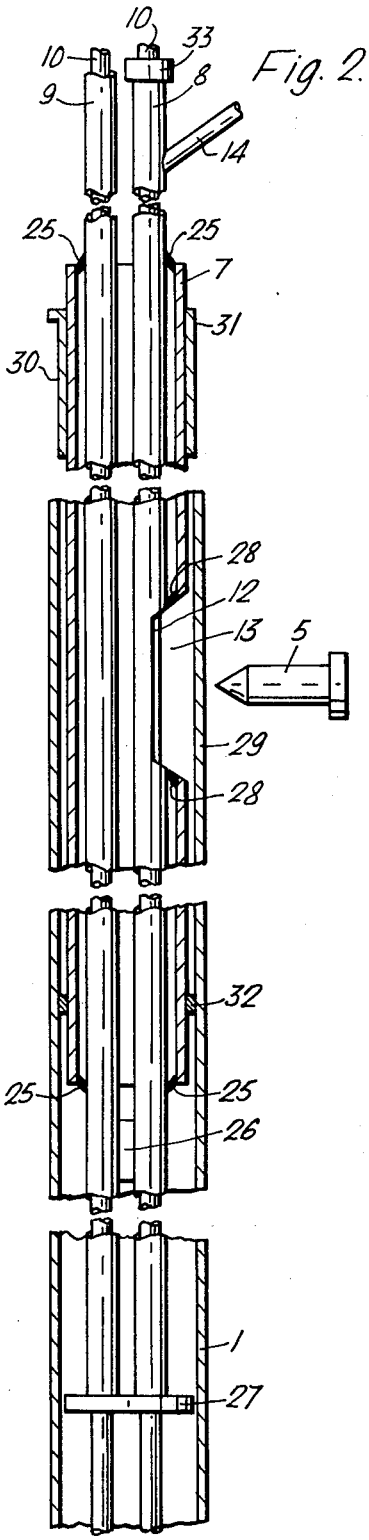
Fig. 2.
Fig. 3.
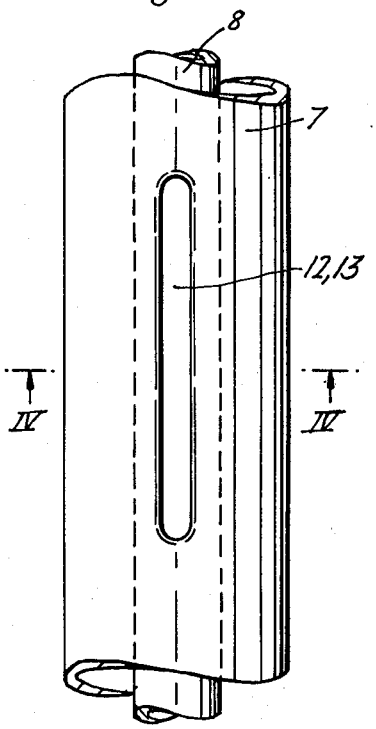
Fig. 4.
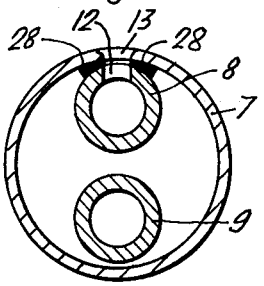

MANUFACTURE OF MINERAL INSULATED CABLES

This invention relates to a process and apparatus for the manufacture of mineral insulated electric cables, that is to say cables of the type consisting of one or more electrical conductor wires enclosed within a tubular metal sheath and insulated from the sheath by compacted powdered insulating material, in which the wires are embedded. The term "mineral insulated cables" is to be understood to include, in addition to wiring cables for the conduction of electric current for general purposes, cables of the construction described above and employed for other purposes, for example heating cables, thermocouple cables, and heating elements for electric cookers.

It has been proposed to manufacture mineral insulated cable by a continuous in-line process (hereinafter referred to as a process of the type specified) which comprises continuously forming the sheath from a travelling strip of ductile metal, for example copper or aluminium, by bending the strip into tubular form and seam welding the abutting edges of the strip together, while the said edges are travelling along a predetermined path, and simultaneously introducing powdered insulating material, such as magnesium oxide, and one or more conductor wires into the sheath so formed, and then passing the resulting assembly through a series of reduction means to compact the insulant powder and to reduce the sheath to the desired overall diameter of the cable, each reduction step being followed by annealing and quenching. The powder may be delivered directly into the bent metal strip before it is closed, or may be fed through a a delivery tube inserted into the sheath-forming strip/tube with the outlet end of the delivery tube located beyond the point at which the welding is effected; in the latter case the wire or wires may be introduced within the powder delivery tube.

We have found that, in carrying out the process of the type described above, difficulties arise as a result of the heat generated by the welding procedure. Thus, where a powder delivery tube is used localised hot spots may occur in the portion of the tube which is positioned adjacent to the abutting edges of the sheath tube in the region in which the welding thereof is effected (which region will hereinafter be referred to as the "weld area"). Such hot spots cause damage to the delivery tube, which may result in the release of powder into the weld area, so damaging the weld. In addition, due to the presence of air on the underside of the seam at the weld point, oxidation of the metal sheath in the welded seam can occur with some metals, especially copper.

It is an object of the present invention to provide an improved process of the type specified whereby the above-described difficulties can be reduced or eliminated, and to provide apparatus for carrying out the improved process.

According to the invention, in a process of the type specified for the manufacture of mineral insulated electric cable, the said conductor wire, or one of the said conductor wires, is introduced into the sheath by being passed through a guide tube extending into the sheath to a point beyond the weld area, as hereinbefore defined, which guide tube has an aperture in its wall located adjacent to the path of travel of the abutting edges of the strip in the weld area, and the assembly of said conductor wire and guide tube and the powdered insulating material is so arranged within the bent sheath-forming metal strip that the powder is excluded from the weld area and that the said conductor wire is directly exposed, through said aperture, to heat generated in the weld area.

The exposure of the said wire to the heat produced by the welding operation enables the excess heat to be continuously removed from the weld area by the wire as it travels into the sheath, so that damage due to overheating is avoided; in particular the powder delivery tube, if present, is protected from thermal damage, whereby exclusion of powder from the weld area is ensured.

The steps of forming the sheath from metal strip, seam welding the sheath, and introducing the insulant powder and the wire or wires into the sheath may be carried out with the metal components travelling either vertically downwards or horizontally: these arrangements will hereinafter be referred to as the "vertical process" and "horizontal process" respectively. In the vertical process, the first reduction and annealing steps are also carried out during the downward travel of the assembly, but thereafter the assembly may be continuously turned through an angle of 90°, the remainder of the reduction, annealing and quenching steps conveniently being carried out during horizontal travel. Each reduction step, in either form of the process, may be effected by rolling, ring rolling, or by drawing the assembly through a die, in knwon manner.

In the vertical process, the insulant powder is introduced into the formed sheath through a powder delivery tube which extends into the sheath so that the powder is delivered at a level below that at which the welding is effected, and the conductor wire or wires are fed into the sheath through the powder delivery tube, one wire being passed through an apertured guide tube as aforesaid and being exposed to heat generated in the weld area through an aperture in the wall of the powder delivery tube which is aligned with, and coextensive with, the aperture in the guide tube. In the horizontal process, however, the powder may be delivered directly into the bent sheath-forming metal strip before the edges thereof are brought into abutment for welding, one conductor again being passed through an apertured guide tube. In order to prevent access of the powder to the vicinity of the weld area, the apertured guide tube is located, in the vicinity of the weld area, in contact with the apertured portion of the powder delivery tube wall in the case of the vertical process, or in contact with the edge regions of the sheath-forming strip in the case of the horizontal process: this arrangement also ensures that the wire exposed in the aperture of the guide tube is held in close proximity to the weld area, for maximum absorption of the excess heat.

According to a further feature of the invention, when the sheath is formed of a readily oxidizable metal such as copper, a continuous stream of rare gas is delivered to the interior surface of the sheath-forming metal strip in the vicinity of the weld area and is released through a gap between the edges of the strip adjacent to the weld area, so that air is excluded from the surfaces of the metal strip in the weld area. The rare gas employed is suitably argon, but helium, neon, krypton or xenon, or a mixture of rare gases, may be used if desired.

Apparatus for carrying out a vertical process in accordance with the invention includes means for continuously bending a downwardly travelling metal strip into the form of a tube and means for seam welding the meeting edges of the bent strip, while the said edges are travelling along a vertically downward path, to form a tubular sheath, a container for powdered insulating material located above the tube-forming means, a vertically disposed powder delivery tube extending from said container, so as to be located within the bent strip and formed sheath, to a level below that of the welding means, which delivery tube has an aperture in a portion of its wall located adjacent to the welding means, means for feeding the powder from the container into the delivery tube at a controlled rate, means for feeding one or more continuous lengths of conductor wire vertically downwards through the powder delivery tube and into the formed sheath, a guide tube located within the powder delivery tube, close to that part of the wall of the powder delivery tube which is adjacent to the path of travel of the meeting edges of the bent metal strip, and having an aperture in its wall aligned with and coextensive with the said aperture in the powder delivery tube wall, through which guide tube said length, or one of said lengths, or wire is arranged to pass, means for retaining the apertured portion of the guide tube wall in contact with the apertured portion of the powder delivery tube wall in the vicinity of the welding means, means for reducing the diameter of the formed sheath, in a plurality of stages, subsequently to the introduction of the powder and the wire or wires into the sheath, and means for annealing and quenching the sheath after each reduction stage, at least the first reduction and annealing means being located vertically below the sheath forming and welding means.

Apparatus for carrying out a horizontal process in accordance with the invention includes means for continuously bending a horizontally travelling metal strip into the form of a tube and means for seam welding the meeting edges of the bent strip while the said edges are travelling along a horizontal path, to form a tubular sheath, means for delivering powdered insulating material at a controlled rate into the partially bent strip, means for feeding one or more continuous lengths of conductor wire horizontally into the formed sheath, a guide tube located so as to lie within the bent strip and to extend into the formed sheath beyond the welding means, and having an aperture in a portion of its wall located adjacent to the welding means, through which guide tube the said length, or one of said lengths, of wire is arranged to pass, means for retaining the apertured portion of said guide tube wall in contact with the interior surface of the bent strip adjacent to the meeting edges thereof in the vicinity of the welding means, means for reducing the diameter of the formed sheath, in a plurality of stages, subsequently to the introduction of the powder and the wire or wires into the sheath, and means for annealing and quenching the sheath after each reduction stage.

When the sheath is formed of a readily oxidizable metal, either of the above-described forms of apparatus will also include means for delivering a continuous stream of rare gas to the interior surface of the bent metal strip adjacent to the edges thereof in the vicinity of the welding means. The gas is preferably delivered to the weld area by being passed through an inlet pipe into the apertured guide tube, the aperture providing an outlet for the gas, enabling it to flood the weld area. Alternatively, the gas may be delivered directly to the weld area through a fine bore tube inserted within the partially formed sheath and terminating opposite to the welding means, or, if a powder delivery tube is used, the gas may be passed through a tube located inside the powder delivery tube and either emerging through the aperture in the wall of the powder delivery tube opposite to the welding means or extending to the outlet of the powder delivery tube and thence up the outside of the powder delivery tube to a point opposite the welding means.

In both the vertical and horizontal forms of the process, the metal strip/sheath and the conductor wire or wires are, of course, arranged to travel in synchronism, and the rate of delivery of the insulating powder into the sheath is controlled, by weight, in synchronism with the rate of travel of the sheath and wire or wires, to achieve the required density of powder within the sheath.

In the manufacture of a cable incorporating a plurality of conductor wires, a guide tube is preferably provided for each of the wires, to facilitate correct location of the wires within the sheath, and to avoid the possibility of the powder introduced around the wires interfering with the freedom of travel of the wires into the sheath, only one of the guide tubes having an aperture in the vicinity of the weld means as aforesaid. The provision of guide tubes for all the wires is particularly desirable in the vertical process, in which the powder is partially compacted under gravity in the early stages of the process. All the guide tubes, including the apertured guide tube, preferably extend into the sheath for a considerable distance beyond the weld area, and beyond the outlet end of the powder delivery tube in the case of the vertical process, all the guide tubes being located within the powder delivery tube. Whether or not guide tubes are used for all the wires, spacer members are preferably provided at one or more points in the path of travel of the assembly of wires within the bent metal strip and formed sheath, to control the positioning of the wires within the sheath. Such spacer members may be so shaped that they will control the flow of the insulant powder into the sheath, so as to ensure correct dispersal and compaction of the powder.

Since, during the procedure of forming the metal strip into a tubular sheath, the formed tube has a tendency to roll so that the meeting edges of the strip, which form the seam of the sheath, may move away from the welding means, for example the tip of the welding head, causing difficulties in welding, it is desirable to provide a seam guide in the form of a thin metal member or members such as a plate or strip or a series of thin rollers, which is or are located in the path of travel of the seam edges and inserted between them before they reach the welding head, so as to keep the seam straight and prevent its misalignment with respect to the welding head. In the case of a horizontal process, in which the apertured wire guide tube is directly in contact with the seam edge regions of the sheath in the vicinity of the weld area, the seam guide may be constituting by a metal plate integral with and extending radially from the said guide tube: the plate is aligned with the aperture, and is thus inserted between the seam edges a short distance before they arrive at the aperture and the welding head. This seam guide plate is suitably held in position by a clamp located outside the formed tube; this combination of the seam guide and the clamp thus serves as the means for retaining the apertured portion of the guide tube in contact with the interior surface of the seam edge regions of the sheath in the vicinity of the welding head.

In the vertical process, while insulating powder within the powder delivery tube in the vicinity of the welding head is excluded from the weld area by retaining the apertured wire guide tube in contact with the powder delivery tube wall as aforesaid, there is still a risk that powder particles carried by entrapped air might be blown back from the outlet end of the powder delivery tube to the weld area, as a result of pressure exerted on the powder in the first reduction stage. In order to prevent this occurring, a sealing ring may be fitted around the powder delivery tube at or near the outlet end thereof, to form a close sliding fit between the powder delivery tube and the travelling sheath. This seal may be of the electrostatic type, or may be formed of a synthetic polymeric material such as polytetrafluoroethylene.

Continuous travel of the metal strip and formed sheath and its contents through the system of tube forming and welding means and reduction, annealing and quenching arrangements, at the desired speed and tension, can be effected by conventional pulling and transporting arrangements, the completed cable finally being wound on to a drum. The cable may be covered with an insulating jacket, for example an extruded tube of polyvinyl chloride or other suitable synthetic plastic material, if required.

Figure 5:
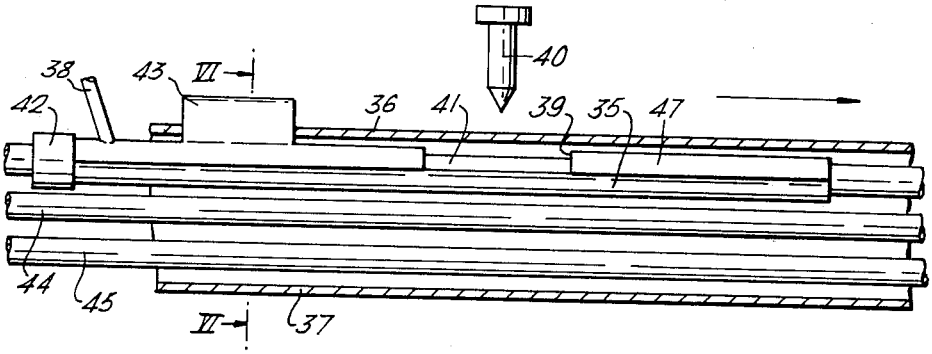
Figure 6:
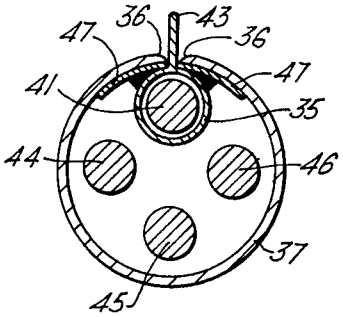

Some specific cable manufacturing processes in accordance with the invention, and apparatus employed for carrying out the processes, will now be described by way of example with reference to the accompanying diagrammatic drawings, in which FIG. 1 shows, in elevation, the plant layout for a vertical process for the manufacture of a mineral insulated cable containing two conductor wires, FIG. 2 is a part-sectional elevation of a part of the apparatus of FIG. 1, FIG. 3 is a plan view of the apertured portions of the powder delivery tube and guide tube shown in FIG. 2, on a larger scale, FIG. 4 is a cross-section drawn on the line IV—IV in FIG. 3, FIG. 5 shows, in part-sectional elevation, a part of the arrangement in a horizontal process for the manufacture of a mineral insulated cable containing four conductor wires, and FIG. 6 is a cross-sectional drawn on the line VI—VI in FIG. 5.

Like parts in the different figures of the drawings are indicated by the same reference numerals. The insulant powder has been omitted from all the figures, for clarity.

In the apparatus shown in FIG. 1, the arrangement for forming the cable sheath 1 from a metal strip 2 consists of a tube forming machine comprising six opposed pairs of tube forming rolls 3 (only one of each of the first and last pairs of rolls are shown in the drawing), a seam guide 4 and an argon arc welding head 5, the seam guide consisting of a series of narrow rollers inserted between the seam edges to prevent misalignment of the seam with respect to the welding head. If desired two welding heads, located a few inches vertically apart, may be provided to permit an overlap of the weld when restarting the process after a temporary discontinuation, or for allowing the change of a welding electrode without the necessity of stopping the process. The arrangement for filling the sheath consists of a small internally heated hopper 6 to which insulant powder is supplied from a larger hopper (not shown), a stainless steel powder delivery tube 7 into which the powder is fed from the hopper 6 and which extends into the sheath 1 for a considerable distance below the welding head 5, and two stainless steel guide tubes 8, 9, enclosed within the powder delivery tube 7, through which guide tubes the conductor wires 10 are introduced into the sheath at a point below the outlet end 11 of the powder delivery tube. Aligned slots 12, 13 are provided in the walls of the powder delivery tube 7 and guide tube 8, respectively, opposite to the welding head, and an inlet pipe 14 for argon gas is provided near the upper end of the guide tube 8.

The apparatus shown in FIG. 1 further includes means for reducing the diameter of the cable in three stages, consisting of a reduction machine 15 and an annealing furnace 16, both situated vertically below the sheath forming and filling arrangements, a water quenching tank 17 in which the cable 18 is turned in a catenary curve to continue travelling horizontally through two further reduction machines 19, 20, followed respectively by annealing furnaces 21, 22 and water quenching tanks 23, 24. Each reduction machine comprises a number of opposed pairs of reducing rolls, of which only two pairs of the machine 15, and one pair of each of machines 19 and 20, are shown in the drawing.

The powder and wire delivery components are shown in more detail in FIG. 2, in which the powder delivery tube 7 and cable sheath 1 are shown in section. The wire guide tubes 8 and 9 are rigidly located in the desired positions within the tube 7 by being soldered to both ends thereof, at 25, and by means of a spacer plate 26 inserted between the two guide tubes just below the outlet end of the powder delivery tube, and a spacer member 27 connecting the guide tubes together at their lower ends and locating the tubes in the correct position in relation to the sheath. In addition the guide tube 8 and the powder delivery tube are soldered together at 28, around their respective aligned slots 12, 13, to ensure that insulant powder in the delivery tube is excluded from the weld area. The slots 12 and 13 enable the wire 10 in guide tube 8 to be exposed to the welding head 5 and thus act as a heat sink, and the slot 12 also serves as an outlet for the argon introduced into the guide tube 8 at 14, to provide an inert atmosphere around the sheath seam 29 in the weld area.

FIG. 2 also shows a ferrule 30 which is placed around the powder delivery tube 7 near its upper end: this ferrule has a flat portion 31 of its surface aligned with the slot 13, to assist in correctly locating the powder delivery tube, within the formed sheath tube, in relation to the welding head. An annular electrostatic seal 32 is fitted around the lower end of the powder delivery tube, to prevent fly-back of airborne insulant powder to the weld area. A ring seal 33 is also fitted around the upper end of the wire guide tube 8, to prevent back flow of the gas introduced through the tube 14.

FIG. 3 shows, in plan view, the shape of the aligned slots 12 and 13 in the guide tube 8 and the powder delivery tube 7, and FIG. 4 shows, in cross-section, that part of the assembly of the powder delivery tube and the guide tubes 8 and 9 which includes the slots 12 and 13.

In the process for manufacturing mineral insulated cable, carried out by means of the appratus shown in FIGS. 1 to 4, the edges of the metal strip 2 are first sheared to provide clean, tapered surfaces suitable for welding, then the strip is checked for correct width and edgewise bow, and is degreased. The wires 10 are passed downwards through means for straightening, locating and tensioning them, and their surfaces are cleaned. The strip and wires are fed continuously from drums through the means (not shown) for carrying out the above operations and thence through the tube forming and wire guiding apparatus described above, while at the same time calibrated quantities of insulant powder are fed from the hopper 6 into the powder delivery tube 7, the tubular sheath 1 being formed and welded before the powder and wires emerge from the powder delivery tube and wire guide tubes respectively, as shown in FIG. 1. Throughout the process a continuous flow of argon is maintained through the guide tube 8 from the inlet 14 to the slot 12. During the tube forming procedure, the accuracy of the bending of the strip is continuously monitored at all stages by a data logger, and corrected if necessary, to ensure that the strip edges will meet in the correct position for welding.

The completed assembly of sheath, wires and powder continues to travel through the series of reduction, annealing and quenching stations, as shown in FIG. 1. The first reduction stage, carried out while the assembly is still travelling vertically downwards, in addition to reducing the diameter of the sheath, compacts the powder and fixes the conductor wires in position. The assembly then passes through pinch rolls which assist in maintaining continuous cable tension through the system, and finally the cable is coiled on a rotating drum; the pinch rolls and drum are of conventional form and are not shown in the drawing. Guide rollers may be provided at any locations in the system where they are required for maintaining the cable or its components in the desired travel path.

In a specific example of the process described above with reference to FIGS. 1 to 4, for the manufacture of a cable consisting of a copper sheath with two inner copper wires and magnesium oxide powder as the insulant, copper strip 65 mm wide is formed into a tubular sheath initially 20 mm in external diameter. The powder delivery tube 7 is 16 mm in external diameter and 2.73 meters long, and for the introduction of copper wires 4.1 mm in diameter guide tubes 8 and 9 of internal diameter 5.5 mm are used; the guide tubes are 3.25 meters long. In the first, second and third reduction stages respectively the cable diameter is reduced to 16 mm, 10 mm; and finally 5.7 mm. The rate of travel of the components and cable through the system is initially two meters per minute, being increased after each reduction, and magnesium oxide powder is supplied to the hopper 6 at the rate of 0.99 Kg per minute.

The arrangement shown in FIGS. 5 and 6 of the drawings, for use in carrying out a horizontal process in accordance with the invention, includes a wire guide tube 35, which is located close to the seam edges 36 of the sheath tube 37, and which has an inlet pipe 38 for argon and a slot 39 positioned adjacent to the welding head 40, this slot providing an outlet for the argon, to maintain an inert atmosphere in the weld area, and permitting the wire 41 within the tube 35 to be exposed to the welding head and thus remove excess heat from the weld area. A ring seal 42 is fitted around the end of the tube 35 upstream of the gas inlet. A seam guide plate 43 extends radially from the tube 35 so as to be inserted between the seam edges 36, and is held in a clamp (not shown), thus also serving to retain the tube 35 in contact with the edge regions of the sheath 37. To ensure the exclusion of insulant powder from the weld area, the tube 35 is provided with arcuate members 47, soldered to the exterior of the tube so as to extend from the portion of the tube which is aligned with the sheath seam, and to fit closely to the interior surface of the sheath on either side of the beam.

The powder may be fed directly into the sheath from a hopper (not shown) located above the sheath-forming strip at an intermediate point in the tube forming system where the strip has been bent into the form of a channel suitable for receiving the powder. The three additional wires 44, 45, 46 are also fed directly into the sheath.

In other respects the horizontal process is similar to the vertical process described above with reference to FIGS. 1 to 4, the assembly shown in FIG. 5 continuing to travel horizontally in the direction indicated by the arrow and passing through a series of reduction, annealing and quenching stations. In the first reduction stage, the powder in the sheath is compacted, and the positions of the wires are adjusted.

If desired, one or more spacers (not shown) may be provided in the arrangement of FIGS. 5 and 6, for controlling the positions of the wires within the sheath.

I claim:

1. A process for the manufacture of mineral insulated electric cable which comprises continuously forming a sheath from travelling metal strip, by bending the strip into tubular form and seam welding the abutting edges of the bent strip together, while the said edges and travelling along a predetermined path, and simultaneously introducing powdered insulating material and at least one conductor wire into the sheath so formed, and then passing the resulting assembly through a series of reduction means to compact the insulant powder and to reduce the diameter of the sheath, each reduction step being followed by annealing and quenching, wherein a said conductor wire is introduced into the sheath by being passed through a guide tube extending into the sheath to a point beyond the region in which said welding is effected, which guide tube has an aperture in its wall located adjacent to the path of travel of the said edges in the said region, and wherein the assembly of said conductor wire and guide tube and the insulant powder is so arranged within the bent sheath-forming metal strip that the powder is excluded from the said welding region and that the said conductor wire is directly exposed, through said aperture, to heat generated by the welding operation.

2. A process according to claim 1, wherein the metal strip, the sheath formed therefrom, and each conductor wire are caused to travel vertically downwards while the steps of forming and welding the sheath, introducing the insulant powder and each wire into the sheath, and at least the first reduction step and first annealing step are carried out, and wherein the powdered insulating material is introduced into the sheath through a powder delivery tube extending into the sheath to a level below the region in which the welding is effected, and each conductor wire is fed into the sheath through the powder delivery tube, the said apertured guide tube being disposed within the powder delivery tube, the conductor wire passing through said guide tube being exposed to heat generated by the welding operation through an aperture in the wall of the powder delivery tube which is aligned with, and coextensive with, the said aperture in the guide tube, and the apertured portion of the guide tube being located, in the vicinity of the said welding region, in contact with the apertured portion of the powder delivery tube wall so that powder is excluded from the said region.

3. A process according to claim 1, wherein the metal strip, the sheath formed therefrom, and each conductor wire are caused to travel horizontally throughout the procedure of forming and welding the sheath, introducing the insulant powder and each wire into the sheath, and carrying out all the reduction, annealing and quenching steps, and wherein the insulant powder is delivered directly into the bent sheath-forming metal strip before the edges thereof are brought into abutment for welding, and the said apertured guide tube is located, in the vicinity of the said welding region, in contact with the edge regions of the sheath-forming strip so that powder is excluded from the said region.

4. A process according to claim 1, wherein a continuous stream of rare gas is delivered to the interior surface of the sheath-forming metal strip in the vicinity of the said welding region, and is released through a gap between the edges of the strip adjacent to the said region, so that air is excluded from the surfaces of the metal strip in the said region.

5. Apparatus for manufacturing mineral insulated electric cable by a process according to claim 2, which includes means for continuously bending a downwardly travelling metal strip into the form of a tube and means for seam welding the meeting edges of the bent strip, while the said edges are travelling along a vertically downward path, to form a tubular sheath, a container for powdered insulating material located above the tube-forming means, a vertically disposed powder delivery tube extending from said container, so as to be located within the bent strip and formed sheath, to a level below that of the welding means, which delivery tube has an aperture in a portion of its wall located adjacent to the welding means, means for feeding the powder from the container into the delivery tube at a controlled rate, means for feeding at least one continuous length of conductor wire vertically downwards through the powder delivery tube and into the formed sheath, a guide tube located within the powder delivery tube, close to that part of the wall of the powder delivery tube which is adjacent to the path of travel of the meeting edges of the bent metal strip, and having an aperture in its wall aligned with, and coextensive with, the said aperture in the powder delivery tube wall, through which guide tube a said length of wire is arranged to pass, means for retaining the apertured portion of the guide tube wall in contact with the apertured portion of the powder delivery tube wall in the vicinity of the welding means, means for delivering a continuous stream of rare gas to the interior surface of the bent metal strip in the vicinity of the welding means, means for reducing the diameter of the formed sheath, in a plurality of stages, subsequently to the introduction of the powder and each wire into the sheath, and means for annealing and quenching the sheath after each reduction stage, at least the first reduction and annealing means being located vertically below the sheath forming and welding means.

6. Apparatus for manufacturing mineral insulated electric cable by a process according to claim 3, which includes means for continuously bending a horizontally travelling metal strip into the form of a tube and means for seam welding the meeting edges of the bent strip, while the said edges are travelling along a horizontal path, to form a tubular sheath, means for delivering powdered insulating material at a controlled rate into the partially bent strip, means for feeding at least one continuous length of conductor wire horizontally into the formed sheath, a guide tube located so as to lie within the bent strip and to extend into the formed sheath beyond the welding means, and having an aperture in a portion of its wall located adjacent to the welding means, through which guide tube a said length of wire is arranged to pass, means for retaining the apertured portion of said guide tube wall in contact with the interior surface of the bent strip adjacent to the meeting edges thereof in the vicinity of the welding means, means for delivering a continuous stream of rare gas to the interior surface of the bent metal strip adjacent to the edges thereof in the vicinity of the welding means, means for reducing the diameter of the formed sheath, in a plurality of stages, subsequently to the introduction of the powder and each wire into the sheath, and means for annealing and quenching the sheath after each reduction stage.

7. Apparatus according to claim 5 wherein, for the manufacture of a cable incorporating a plurality of conductor wires, a guide tube is provided for each of the wires, only one of said guide tubes having an aperture in its wall in the vicinity of the welding means, wherein all of said guide tubes are located within the powder delivery tube and extend below the outlet end of the powder delivery tube, and wherein at least one spacer member is provided in the path of travel of the assembly of wires within the bent metal strip and formed sheath, to control the positioning of the wires within the sheath.

8. Apparatus according to claim 6 wherein, for the manufacture of a cable incorporating a plurality of conductor wires, a guide tube is provided for each of the wires, only one of said guide tubes having an aperture in its wall in the vicinity of the welding means, and wherein at least one spacer member is provided in the path of travel of the assembly of wires within the bent metal strip and formed sheath, to control the positioning of the wires within the sheath.

9. Apparatus according to claim 5, which includes seam guiding means consisting of at least one thin metal member located in the path of travel of the edges of the bent metal strip and insertable between the said edges before they reach the welding means.

10. Apparatus according to claim 6 which includes seam guiding means consisting of a metal plate integral with and extending radially from the said apertured guide tube, aligned with the aperture in said guide tube, and located so as to be insertable between the edges of the bent metal strip before they reach the welding means, and clamp means for holding said plate in such a position that the apertured portion of the guide tube is thereby retained in contact with the interior surface of the edge regions of the bent metal strip in the vicinity of the welding means.

* * * * *